US010570875B2

(12) United States Patent
Miller et al.

(10) Patent No.: US 10,570,875 B2
(45) Date of Patent: Feb. 25, 2020

(54) EFFICIENCY ENHANCEMENT TO A LASER IGNITION SYSTEM

(71) Applicant: Ford Global Technologies, LLC, Dearborn, MI (US)

(72) Inventors: Kenneth James Miller, Canton, MI (US); Douglas Raymond Martin, Canton, MI (US); Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 575 days.

(21) Appl. No.: 15/280,752

(22) Filed: Sep. 29, 2016

(65) Prior Publication Data

US 2018/0087483 A1 Mar. 29, 2018

(51) Int. Cl.

| | |
|---|---|
| ***F02P 23/04*** | (2006.01) |
| ***F02D 35/02*** | (2006.01) |
| ***F02N 19/02*** | (2010.01) |
| ***F02D 41/04*** | (2006.01) |
| *F02D 41/30* | (2006.01) |

(52) U.S. Cl.

CPC ..... *F02P 23/04* (2013.01); *F02D 35/022* (2013.01); *F02D 41/047* (2013.01); *F02N 19/02* (2013.01); *F02D 35/026* (2013.01); *F02D 41/3094* (2013.01); *F02D 2200/021* (2013.01); *F02D 2200/0812* (2013.01)

(58) Field of Classification Search

CPC ..... F02P 23/04; F02N 19/02; F02D 35/022; F02D 35/026; F02D 41/047; F02D 41/3094; F02D 2200/0812; F02D 2200/021

See application file for complete search history.

(56) References Cited

U.S. PATENT DOCUMENTS

| | | | | |
|---|---|---|---|---|
| 4,852,529 | A | 8/1989 | Vowles | |
| 6,796,278 | B2 | 9/2004 | Ryan, III | |
| 7,354,379 | B2 * | 4/2008 | Moriya | F02N 11/0833 477/199 |
| 8,042,510 | B2 | 10/2011 | Martin et al. | |
| 8,265,851 | B2 * | 9/2012 | Girouard | F01D 17/02 701/99 |
| 8,297,248 | B2 | 10/2012 | Martin et al. | |
| 8,935,996 | B2 * | 1/2015 | Mulye | F02B 47/02 123/25 A |
| 9,194,339 | B2 * | 11/2015 | Mulye | F02B 47/02 |
| 9,212,970 | B2 | 12/2015 | Martin et al. | |
| 9,217,638 | B2 | 12/2015 | Martin et al. | |
| 9,222,455 | B2 | 12/2015 | Martin et al. | |
| 9,243,603 | B2 | 1/2016 | Martin et al. | |
| 9,255,565 | B2 | 2/2016 | Martin et al. | |
| 9,272,706 | B2 | 3/2016 | Martin et al. | |
| 9,726,076 | B2 * | 8/2017 | Mulye | F02B 47/02 |
| 2014/0136085 | A1 | 5/2014 | Martin et al. | |
| 2014/0149018 | A1 | 5/2014 | Martin et al. | |
| 2014/0324324 | A1 | 10/2014 | Martin et al. | |

* cited by examiner

*Primary Examiner* — Grant Moubry

(74) *Attorney, Agent, or Firm* — Geoffrey Brumbaugh; McCoy Russell LLP

(57) ABSTRACT

Methods and systems are provided for expediting heating of intake valves to improve engine startability. An engine laser ignition system is operated prior to, and during, an engine start to heat intake valves, thereby improving fuel vaporization. The ignition system is also operated to initiate cylinder air/fuel combustion.

6 Claims, 4 Drawing Sheets

EFFICIENCY ENHANCEMENT TO A LASER IGNITION SYSTEM

FIELD

The present application relates to methods and systems for a laser ignition system.

BACKGROUND AND SUMMARY

In engines configured with port injection, during the engine start as well as the engine warm-up period, the presence of a cold intake valve can result in poor fuel vaporization. This can cause poor tailpipe emissions, engine hesitations, and poor engine start robustness. The issues may be exacerbated in hybrid vehicles where the engine remains shutdown for prolonged periods of time. To compensate for the emissions, expensive emissions control systems may be required, such as catalysts including increased levels of precious metals, or even specialized systems that enable the exhaust catalyst to be electrically heated. Still other approaches that include heavy spark retard usage or increased fuel injection result in wasted fuel economy.

The inventors herein have recognized that fuel vaporization and resulting tailpipe emissions are highly sensitive to intake valve temperature. In particular, the fuel injector sprays into the intake manifold near the back-side of the intake valve. Then when the intake valve opens, the fuel passes over the intake valve as the fuel is sucked into the chamber. This proximity makes the intake valve temperature influence the fuel vaporization and resulting emissions. As such, since the intake valve is in direct contact with the fuel, and because it is low mass, it can heat up faster than the engine combustion chamber walls or the intake manifold.

Internal combustion engines may also be configured with a laser system that includes a laser ignition device coupled to each engine cylinder. The laser system may be used for various approaches, such as to initiate cylinder fuel combustion and controlling a pilot injection by changing the energy level of a laser pulse directed into the engine. As another example, a photodetector of the laser ignition system may be used for determining the position of a piston inside the cylinder. The inventors herein have recognized that laser ignition systems can be leveraged to expedite intake valve heating. In particular, a laser beam can be used to sweep the intake valve surface and increase the intake valve temperature. In one example, emissions related to poor fuel vaporization, particularly in port injected engines, may be reduced by a method for an engine, comprising: operating a laser ignition device with an output that is adjusted from (for example to be lower than) a level for initiating cylinder ignition, the output adjusted based on intake valve temperature.

As one example, prior to an engine start, such as when a vehicle is unlocked by the operator, an intake valve temperature may be estimated and/or inferred based on the output of one or more engine sensors. A target valve temperature is then determined based on ambient conditions such as ambient temperature, barometric pressure, as well as fuel conditions including octane content of fuel available in the fuel tank. A laser ignition device of the engine may then be operated at a lower power level (than the power level required to initiate cylinder ignition), even before an engine start is requested, to expedite valve warming. The output of the laser device, including a pulse frequency of the laser beam, may be adjusted based on a difference between the estimated valve temperature and the target valve temperature. For example, the power level for valve heating may be reduced from the power level for cylinder ignition at a degree based on the difference between the estimated valve temperature and the target valve temperature. This allows the laser output to sufficiently heat the valve without damaging it. In addition, a target of the laser beam may be adjusted to perform a planar sweep of the intake valve. The engine may then be started, with cylinder fuel injection being resumed, after a threshold rise in intake valve temperature has occurred. Once the engine is started, the laser is continued to be operated in the lower power level during a cylinder intake stroke until the target valve temperature is attained. In one example, the controller may choose to delay the first engine start if the benefit of heating the valve exceeds the benefit of immediately starting the engine, such as in a hybrid vehicle where the vehicle may be propelled by the electric motor while the valve is warming up. For example, the beam trajectory may be adjusted so that the beam sweeps across the bottom of the intake valve when the valve is closed at the beginning of an intake stroke, and then follows the portion of the top of the intake valve that is within line of sight of the laser during the course of the intake stroke. During some conditions, such as very cold ambient conditions where the laser may not have enough time or energy to heat the entire intake valve before the engine start, the laser beam may be used to heat a smaller area of the intake valve to create a hot-spot. As such, after the engine has been started, the laser operation for heating the intake valve is performed in addition to laser operation at a higher power level during a compression stroke to enable cylinder combustion. Once the target valve temperature is reached, the lower power laser operation for valve heating may be disabled. The valve temperature may then continue to be monitored during engine operation, and laser operation in the lower power mode for valve heating may be resumed if the valve temperature drops, such as during a prolonged DFSO condition.

In this way, cylinder intake valves may be warmed by using existing engine components, such as an existing laser ignition system, without adding costs. By warming up the intake valve during or prior to starting an engine, fuel vaporization may be enhanced, improving engine start performance, particularly in engines fueled via port injection. In addition, warming up of the intake valve may reduce engine cold-start emissions. By maintaining the intake valve warm even during DFSO conditions, or during prolonged hybrid vehicle operation in an electric mode, engine hesitations are reduced.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
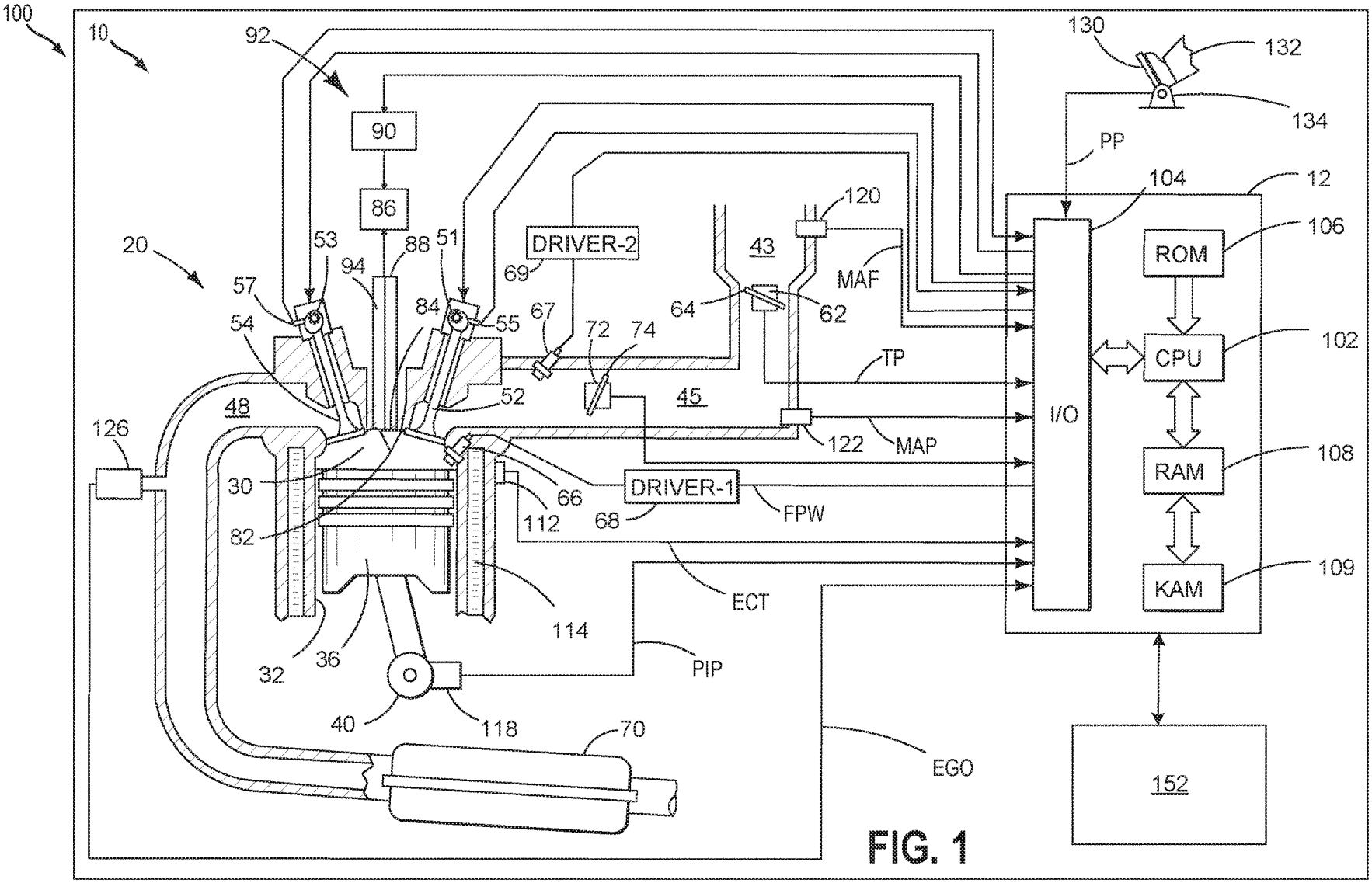
FIG. 1 shows an example combustion chamber of an internal combustion engine coupled in a hybrid vehicle system.
Figure 3:
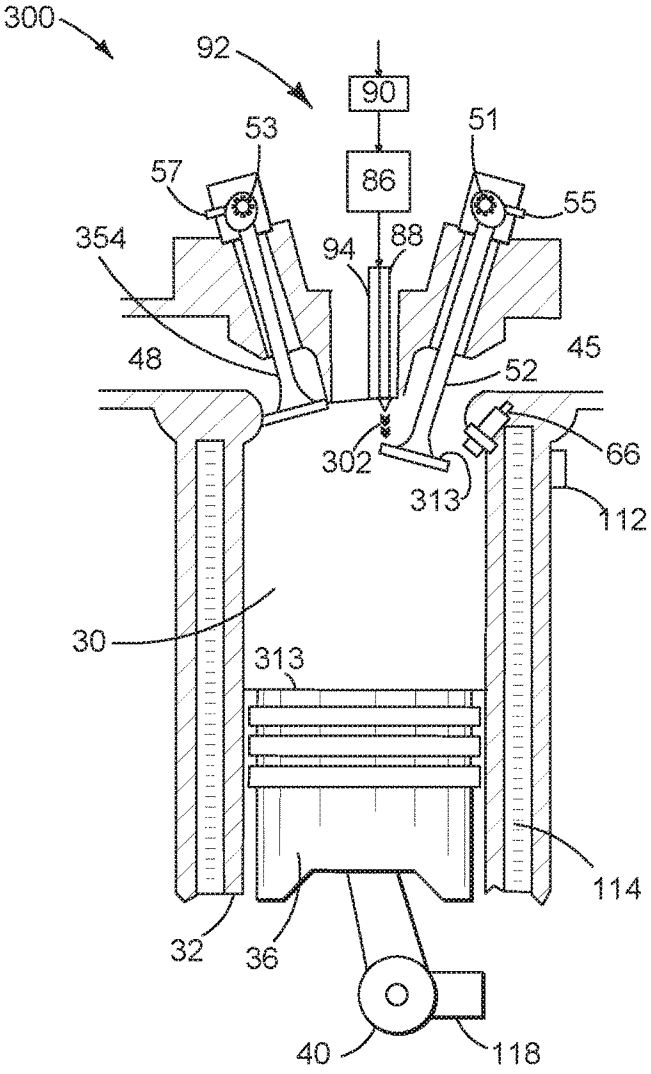
FIG. 3 shows an example of a laser pulse sweeping an intake valve of an engine cylinder.
Figure 2:
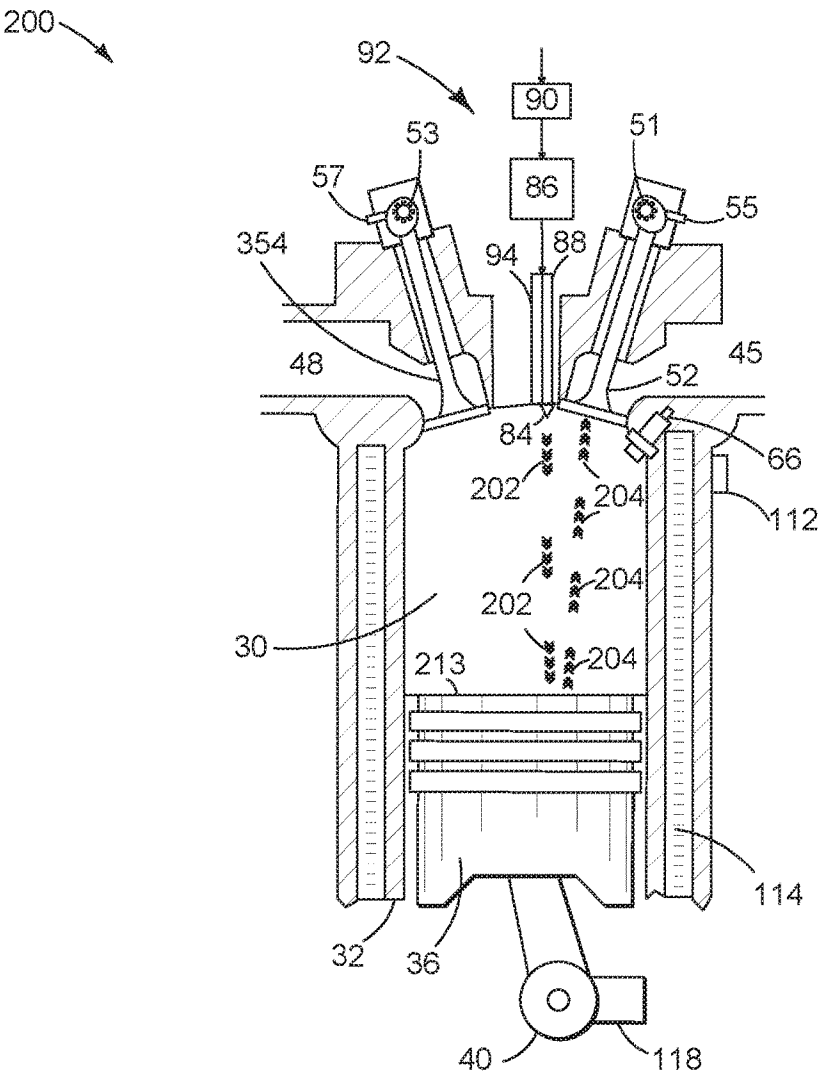
FIG. 2 shows an example of a laser pulse sweeping a piston of an engine cylinder.

Methods and systems are provided for leveraging the components of a laser ignition system, such as the system of FIG. 1, for warming a cylinder intake valve prior to or during engine operation. As shown at FIGS. 2-3, a lower power laser pulse emitted from the laser ignition system may be used to sweep the inside of a cylinder as well as the surface of an intake valve. Laser pulse emission at higher intensities may also be used for initiating combustion. An engine controller may be configured to perform a control routine, such as the example routine of FIG. 4, to adjust the output and trajectory of the lower power laser pulse based on an intake valve temperature to improve fuel vaporization. An example laser operation for intake valve heating is shown with reference to FIG. 5.

Turning to FIG. 1, an example hybrid propulsion system 10 is depicted. The hybrid propulsion system may be configured in a passenger on-road vehicle, such as hybrid electric vehicle 100. Hybrid propulsion system 10 includes an internal combustion engine 20. The engine may be coupled to a transmission (not shown), such as a manual transmission, automatic transmission, or combinations thereof. Further, various additional components may be included, such as a torque converter, and/or other gears such as a final drive unit, etc. The hybrid propulsion system also includes an energy conversion device 152, which may include a motor, a generator, among others and combinations thereof. The energy conversion device may be operated to absorb energy from vehicle motion and/or the engine and convert the absorbed energy to an energy form suitable for storage at an energy storage device. The energy conversion device may also be operated to supply an output (power, work, torque, speed, etc.) to engine 20, so as to augment the engine output. It should be appreciated that the energy conversion device may, in some embodiments, include a motor, a generator, or both a motor and generator, among various other components used for providing the appropriate conversion of energy between the energy storage device and the vehicle drive wheels and/or engine.

Engine 20 may be a multi-cylinder internal combustion engine, one cylinder of which is depicted in detail at FIG. 1. Engine 20 may be controlled at least partially by a control system including controller 12 and by input from a vehicle operator 132 via an input device 130. In this example, input device 130 includes an accelerator pedal and a pedal position sensor 134 for generating a proportional pedal position signal PP.

Combustion cylinder 30 of engine 20 may include combustion cylinder walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of propulsion system 10 via an intermediate transmission system. Combustion cylinder 30 may receive intake air from intake manifold 45 via intake passage 43 and may exhaust combustion gases via exhaust passage 48. Intake manifold 45 and exhaust passage 48 can selectively communicate with combustion cylinder 30 via respective intake valve 52 and exhaust valve 54. In some embodiments, combustion cylinder 30 may include two or more intake valves and/or two or more exhaust valves.

Engine 20 may optionally include cam position sensors 55 and 57. However, in the example shown, intake valve 52 and exhaust valve 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. To enable detection of cam position, cam actuation systems 51 and 53 may have toothed wheels. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown coupled directly to combustion cylinder 30 for injecting fuel directly therein in proportion to the pulse width of signal FPW-2 received from controller 12 via electronic driver 68. In this manner, fuel injector 66 provides what is known as direct injection of fuel into combustion cylinder 30. The fuel injector may be mounted on the side of the combustion cylinder or in the top of the combustion cylinder, for example. Fuel may be delivered to fuel injector 66 by a fuel delivery system (not shown) including a fuel tank, a fuel pump, and a fuel rail. Fuel injector 67 is shown arranged in intake passage 43 in a configuration that provides what is known as port injection of fuel into the intake port upstream of combustion cylinder 30. Fuel injector 67 delivers fuel into the intake port in proportion to the pulse width of signal FPW-2 received from controller 12 via electronic driver 69. In this manner, fuel injector 67 provides what is known as port injection of fuel into combustion cylinder 30.

The inventors herein have recognized that during engine start and warm-up, when the intake valve is cold, fuel vaporization may be poor, particularly when the fuel is delivered via port injection. To improve port fuel vaporization, prior to an engine start, as well as during engine operation, an intake valve temperature may be monitored and operation of a laser ignition device of the engine (LCU 90) may be adjusted to maintain the intake valve temperature at or above a target temperature selected based on engine operating conditions. As elaborated herein, during those conditions, the LCU 90 may be operated to deliver low power laser pulses onto a top and/or bottom surface of the intake valve, thereby expediting valve warm-up.

Intake passage 43 may include a charge motion control valve (CMCV) 74 and a CMCV plate 72 and may also include a throttle 62 having a throttle plate 64. In this particular example, the position of throttle plate 64 may be varied by controller 12 via a signal provided to an electric motor or actuator included with throttle 62, a configuration that may be referred to as electronic throttle control (ETC). In this manner, throttle 62 may be operated to vary the intake air provided to combustion cylinder 30 among other engine combustion cylinders. Intake passage 43 may include a mass air flow sensor 120 and a manifold air pressure sensor 122 for providing respective signals MAF and MAP to controller 12.

Exhaust gas sensor 126 is shown coupled to exhaust passage 48 upstream of catalytic converter 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a $NO_x$, HC, or CO sensor. The exhaust system may include light-off catalysts and underbody catalysts, as well as exhaust manifold, upstream and/or downstream air/fuel ratio sensors. Catalytic converter 70 can include multiple catalyst bricks, in one example. In another example, multiple emission control devices, each with multiple bricks, can be used. Catalytic converter 70 can be a three-way type catalyst in one example.

Controller 12 is shown in FIG. 1 as a microcomputer, including microprocessor unit 102, input/output ports 104, an electronic storage medium for executable programs and calibration values shown as read-only memory chip 106 in this particular example, random access memory 108, keep alive memory 109, and a data bus. The controller 12 may receive various signals and information from sensors coupled to engine 20, in addition to those signals previously discussed, including measurement of inducted mass air flow (MAF) from mass air flow sensor 120; engine coolant temperature (ECT) from temperature sensor 112 coupled to cooling sleeve 114; in some examples, a profile ignition pickup signal (PIP) from Hall effect sensor 118 (or other type) coupled to crankshaft 40 may be optionally included; throttle position (TP) from a throttle position sensor; and absolute manifold pressure signal, MAP, from sensor 122. The Hall effect sensor 118 may optionally be included in engine 20 because it functions in a capacity similar to the engine laser system described herein. Storage medium read-only memory 106 can be programmed with computer readable data representing instructions executable by processor 102 for performing the methods described below as well as variations thereof.

Laser system 92 includes a laser exciter 88 and a laser control unit (LCU) 90. LCU 90 causes laser exciter 88 to generate laser energy. LCU 90 may receive operational instructions from controller 12. Laser exciter 88 includes a laser oscillating portion 86 and a light converging portion 84. The light converging portion 84 converges laser light generated by the laser oscillating portion 86 on a laser focal point 82 of combustion cylinder 30. In one example, light converging portion 84 may include one or more lenses.

A photodetector 94 may be located in the top of cylinder 30 as part of laser system 92 and may receive return pulses from the top surface of piston 36. Photodetector 94 may include a camera with a lens. In one example, the camera is a charge coupled device (CCD). The CCD camera may be configured to detect and read laser pulses emitted by LCU 90. In one example, when the LCU emits laser pulses in an infra-red frequency range, the CCD camera may operate and receive the pulses in the infra-red frequency range. In such an embodiment, the camera may also be referred to as an infrared camera. In other embodiments, the camera may be a full-spectrum CCD camera that is capable of operating in a visual spectrum as well as the infra-red spectrum. The camera may include a lens for focusing the detected laser pulses and generating an image of the interior of the cylinder. In one example, the lens is a fish-eye lens that creates a wide panoramic or hemispherical image of the inside of the cylinder. After laser emission from LCU 90, the laser sweeps within the interior region of cylinder 30. In one example, during cylinder laser ignition as well as during conditions when a cylinder piston position is to be determined, the laser may sweep the interior region of the cylinder at laser focal point 82. In another example, during conditions when the LCU is operated for intake valve warming, the laser may sweep the interior region of the cylinder at a focal point located on the top surface of intake valve 52. Light energy that is reflected off of piston 36 may be detected by the camera in photodetector 94. Photodetector 94 may also capture images of the intake valve and the interior of the cylinder.

It will be appreciated that while laser system 92 is shown mounted to a top of the cylinder, in alternate examples, the laser system may be configured with the laser exciter mounted on the side of the cylinder, substantially facing the valves.

Laser system 92 is configured to operate in more than one capacity with the timing and output of each operation based on engine position of a four-stroke combustion cycle. For example, laser energy may be utilized for igniting an air/fuel mixture during a power stroke of the engine, including during engine cranking, engine warm-up operation, and warmed-up engine operation. Fuel injected by fuel injector 66 may form an air/fuel mixture during at least a portion of an intake stroke, where igniting of the air/fuel mixture with laser energy generated by laser exciter 88 commences combustion of the otherwise non-combustible air/fuel mixture and drives piston 36 downward. Furthermore, light generated during the cylinder combustion event may be used by photodetector 94 for capturing images of an interior of the cylinder and assessing progress of the combustion event (e.g., for monitoring flame front progression).

In a second operating capacity, LCU 90 may deliver low powered pulses to the cylinder. The low powered pulses may be used to determine piston and valve position during the four-stroke combustion cycle. In addition, upon reactivating an engine from idle-stop conditions, laser energy may be utilized to monitor the position, velocity, etc. of the engine in order to synchronize fuel delivery and valve timing. Furthermore, light generated by the laser light pulse emission at the lower power may be used for capturing images of an interior of the cylinder before a cylinder combustion event occurs, such as during an intake stroke.

For example, the laser ignition device, coupled to photodetector 94, may transmit light pulses into cylinder 30 while photodetector 94, including an infrared camera equipped with a fish-eye lens, generates images that are transmitted wirelessly to an engine controller and viewed on the display of the vehicle.

Figure 4:
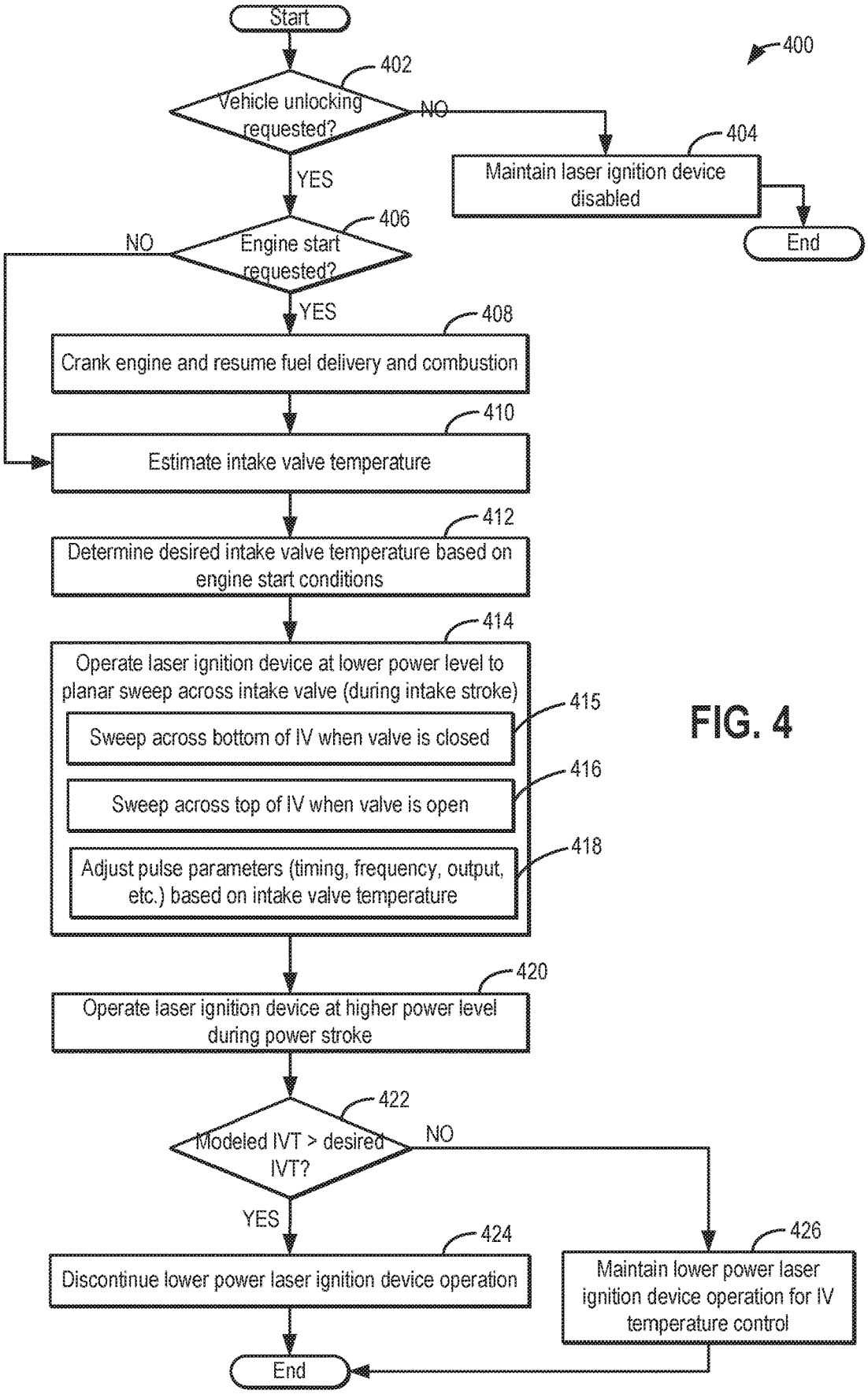
FIG. 4 shows a high level flow chart of a method for operating a laser ignition device for maintaining the temperature of a cylinder intake valve.

As elaborated at FIGS. 3-4, LCU 90 may also be operated to deliver the low powered pulses prior to an engine start, as well during engine operation in a DFSO mode, to heat the intake valve and maintain the intake valve above a threshold temperature that enables improved fuel vaporization and reduced tailpipe emissions. Therein, the output and timing of the laser pulses, as well as a trajectory (and focal point) of the laser beam may be adjusted to sweep the intake valve. In addition, images of the intake valve captures using the light generated by the laser light pulse emission may be used for valve control. Further still, to improve the efficiency of intake valve heating via the laser, in some examples the intake valve may be mounted at a steeper angle off the horizontal axis.

LCU 90 may direct laser exciter 88 to focus laser energy at different locations depending on operating conditions. For example, the laser energy may be focused at a first location away from cylinder wall 32 within the interior region of cylinder 30 in order to ignite an air/fuel mixture. In one embodiment, the first location may be near top dead center (TDC) of a power stroke. Further, LCU 90 may direct laser exciter 88 to generate a first plurality of laser pulses directed to the first location, and the first combustion from rest may receive laser energy from laser exciter 88 that is greater than laser energy delivered to the first location for later combustions. As another example, the laser energy may be focused at a second location towards the cylinder wall closest to the intake port of the cylinder in order to diagnose an injector spray pattern or an intake air flow pattern.

As yet another example, LCU 90 may direct laser exciter 88 to a third location on a top surface of the intake valve to heat the intake valve and maintain the valve temperature above a threshold temperature. In one example, where the ambient temperature is very cold, the third location may be selected to create a hot spot on the intake valve to expedite valve warming during a very cold engine start, thereby improving fuel vaporization during the engine start.

Controller 12 controls LCU 90 and has non-transitory computer readable storage medium including code to adjust the location of laser energy delivery based on temperature, for example the ECT. Laser energy may be directed at different locations within cylinder 30. Controller 12 may also incorporate additional or alternative sensors for determining the operational mode of engine 20, including additional temperature sensors, pressure sensors, torque sensors as well as sensors that detect engine rotational speed, air amount and fuel injection quantity. Additionally or alternatively, LCU 90 may directly communicate with various sensors, such as temperature sensors for detecting the ECT, for determining the operational mode of engine 20.

As described above, FIG. 1 shows one cylinder of multi-cylinder engine 20, and each cylinder may similarly include its own set of intake/exhaust valves, fuel injector, laser ignition system, etc.

The controller 12 receives signals from the various sensors of FIG. 1 and employs the various actuators of FIG. 1 to adjust engine and vehicle operation based on the received signals and instructions stored on a memory of the controller. For example, responsive to a lower than threshold intake valve temperature, as modeled based on input from the various intake temperature and pressure sensors, the controller may adjust the output of LCU 90, such as by operating the laser exciter to emit low energy pulses at a higher frequency directed towards the top surface of the intake valve as the valve opens and closes during an intake stroke. As another example, responsive to an indication of vehicle unlocking, and before an engine start request is received from the vehicle operator, the controller may operate the laser exciter to heat the intake valves of all the engine cylinders.

FIGS. 2-3 illustrate how laser system 92 emits pulses into cylinder 30 described above with reference to FIG. 1. It will be appreciated that components introduced in FIG. 1 are similarly numbered in FIGS. 2-3 and not reintroduced.

During cylinder combustion, high energy laser pulses, such as pulse 202, may be directed toward a top surface 213 of piston 36. A plurality of laser pulses 202 may be generated during a power stroke of the cylinder to initiate a combustion event in the cylinder. Laser pulse 302 may be configured to sweep the cylinder piston to trigger combustion. The laser output, including the energy level of the laser pulse and a frequency/timing of the laser pulses may be selected based on the engine speed and the combustion air/fuel ratio. For example, a leaner air/fuel mixture may operate with a higher laser energy level than a less lean, or more rich air/fuel mixture in order to combust the lean air/fuel mixture more efficiently, and lower engine speeds may be associated with a poor mixture of air and fuel, and therefore may also benefit from a higher laser energy level than higher engine speeds in order to improve combustion.

During engine position determination conditions, LCU 90 causes laser exciter 88 to generate a low powered laser pulse 202 to be directed towards top surface 213 of piston 36. After emission, the light energy may be reflected off of the piston and detected by the photodetector 94. Pulse 202 may be reflected from the top surface of the piston and a return pulse, e.g., pulse 204, may be received by laser system 92, which may be used to determine a position of piston 36 within cylinder 30. In some examples, the location of the piston may be determined by frequency modulation methods using frequency-modulated laser beams with a repetitive linear frequency ramp. Alternatively, phase shift methods may be used to determine the distance. By observing the Doppler shift or by comparing sample positions at two different times, piston position, velocity and engine speed information (RPM measurement) may be inferred. When cylinder identity (CID) is combined with piston location, the position of the engine may be determined and used to synchronize fuel delivery and valve timing. Such positional states of the engine may be based on piston positions and CIDs determined via lasers.

LCU 90 may receive operational instructions, such as a power mode, from controller 12. For example, during ignition, the laser pulse used may be pulsed quickly with high energy intensity to ignite the air/fuel mixture. Conversely, to determine the engine position, the controller may direct the laser system to sweep frequency at low energy intensity to determine piston position. For instance, frequency-modulating a laser with a repetitive linear frequency ramp may allow a determination of one or more piston positions in an engine. A detection sensor, such as photodetector 94, may be located in the top of the cylinder as part of the laser system and may be calibrated to receive return pulse 204 reflected from top surface 213 of piston 36.

During conditions where intake valve warming is required, low energy laser pulses, such as pulse 302, may be directed toward a top surface 313 of intake valve 52. In particular, a plurality of laser pulses 302 may be generated during an intake stroke of the cylinder to sweep the intake valve. The pulse duty cycle may reach 100% wherein the laser light stays on, and the amount of thermal energy delivered to any one spot on the valve may be controlled by the speed of the laser sweep. For example the controller may sweep the laser faster to distribute the heat more. The beam sweeps across the bottom of the valve when the intake valve is closed. Then, as the intake valve opens into the chamber during the intake stroke, the beam follows the portion of the top surface 313 of the intake valve that is within the line of sight of the laser. In one example, intake valve heating may be improved in engine systems configured with the laser positioned on the side of the cylinder, and the intake valve mounted at a steeper angle off the horizontal axis of the cylinder. As such, during the intake stroke, when valve 52 opens into the chamber, the laser has a better line of sight to the valve to heat the valve.

The angle and resulting location of laser energy delivery may also be adjusted during cylinder combustion events, for example based on a position of the piston 36 relative to TDC. In one example, an ignition event that triggers fuel combustion may be enabled by focusing the laser pulse onto a defined region on top surface 213 of piston 36. As another example, during valve warming, the laser pulse may be focused onto a defined region on the top surface 313 of intake valve 52.

Controller 12 may also incorporate additional or alternative sensors for determining the operational mode of engine 20, including additional temperature sensors, pressure sensors, torque sensors as well as sensors that detect engine rotational speed, air amount and fuel injection quantity as described above with regard to FIG. 1. Additionally or alternatively, LCU 90 may directly communicate with various sensors, such as Hall effect sensors 118, whose inclusion is optional, for determining the operational mode of engine 20.

Turning now to FIG. 4, an example method is shown for operating the laser system of FIG. 1 for intake valve heating, as well as for initiating cylinder combustion. Instructions for carrying out method 400 may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below.

At 402, the method includes determining if a request has been received for unlocking the vehicle. This may include the vehicle operator pressing an unlock button on a vehicle key fob, unlocking the vehicle door via a key, or opening the vehicle door. If not, then at 404, the laser ignition device of the engine is maintained as disabled.

At 406, it may be determined if an engine start has been requested. If an engine start has not been requested, the routine may move directly to 410, responsive to the vehicle being unlocked to start warming the intake valve (as elaborated below). This enables the intake valve to be warmed by the time the engine is started, reducing cold-start emissions and improving engine startability, particularly when the engine is fueled with at least some port injected fuel on the engine start. It will be appreciated that in alternate examples, the intake valve warming may be initiated responsive to an alternate vehicle pre-conditioning prior to engine start, such as a period of time prior to or including when the pre-conditioning is scheduled to end. The vehicle pre-conditioning may include, for example, a demand for cabin cooling or heating prior to operator entry inside the vehicle.

In still other examples, intake valve warming may be initiated when the vehicle "wakes-up" due to a customer approaching vehicle. Some vehicles may operate the processors in a sleep mode and "wake-up the processors" as a customer approaches the vehicle. As such, this may be related to, but different from a vehicle unlock, or vehicle pre-condition.

If an engine start is confirmed, at 408, the method includes cranking the engine, such as via a starter motor, and resuming cylinder fuel delivery. In addition, cylinder fuel combustion is resumed. As elaborated below, based on intake valve temperature, the laser device of the engine system may be operated for valve heating and ignition concurrently. In other words, the controller may use the laser for valve heating during any portions of the four engine strokes where laser ignition is not immediately active. However, by initiating the valve heating before the engine start, and continuing the valve heating during the engine start, greater temperature rises can be enabled.

At 410, the method includes estimating the intake valve temperature. In one example, the temperature of the intake valve of a cylinder in which a combustion event is about to occur may be determined (that is, next firing cylinder). In another example, the intake valve temperature for all engine cylinders may be determined. The intake valve temperature (IVT) may be modeled based on input received from one or more existing engine sensors, such as based on intake air temperature, manifold air flow, engine speed, and exhaust temperature. It will be appreciated that the intake valve temperature may be intermittently modeled, such as every time a threshold amount of time (e.g., seconds) or a threshold number of combustion events have elapsed.

During conditions where the laser device is operated to heat the valve as well as initiate cylinder combustion, the modeled intake valve temperature may also take into account the laser heat along with the combustion heat, as well as intake air heat transfer. As an example, engine component temperatures along the air path may be used as an input for a model used to be controller to determine valve temperature, the model using equations with calibratable parameters that are determined for a particular engine design. The equation or model for valve temperature may be a function of variables such as one or more of ambient temperature, number of combustion events counted from a first combustion event of an engine start, time elapsed since an engine start, soak time or time since engine stop (or shutdown event), air mass flowrate and/or engine load, spark timing, and air-fuel ratio. The calibratable constants may include valve mass, empirical engine component temperature tables or empirical constants in the temperature equation. The valve temperature model may integrate by determining the additional heat added on a given event and thereby calculate a corresponding temperature change to the intake valve since a last update. Then the calculated temperature change is added that to the last update to learn a most current valve temperature estimate. For example, the valve temperature may be learned according to the equation:

Valve temp=valve temp calculated during last update+ temperature delta as a function the heat transfer delta to the valve based on all of parameters listed above.

At 412, the method includes determining a desired or target intake valve temperature (IVT) as a function of engine operating conditions. For example, the desired IVT may be determined as a function of engine speed and load, driver torque demand, engine temperature at the time of the engine start, and ambient temperature at the time of the engine start. As an example, as the engine temperature and/or the engine speed/load increases, the target IVT may be increased. In still other examples, the desired IVT may be determined as a function of tailpipe emissions, engine start robustness, and probability of hesitation sensitivity. For example, as the expected tailpipe emissions increase (or as a particulate matter load of an exhaust filter increases), the target IVT may be increased. As another example, as the percentage of fuel delivered at the engine start via port injection (relative to direct injection) increases, the target IVT may be increased. It will be appreciated that the target IVT may also be adjusted for each combustion event as a function of the combustion number since a first combustion event of the engine start.

For example, for a 20° F. ambient temperature condition with a fully soaked vehicle, the IVT may start at 20° F. plus the temperature increase from the laser. Then as each combustion event happens for that cylinder, the combustion heat plus additional laser heat will cause the valve to increase in temperature. For example, the laser heat may raise the valve temp to 50° F. on the first combustion event. Then, if each combustion event normally raised the temperature by 2° F. and the added laser heat raises the valve temperature by one additional degree, then the valve would warm by 3° F. per subsequent combustion event. Then the increase may lessen as the valve approaches a stabilized temperature.

At 414, the method includes operating the laser ignition device at a power level that is adjusted from a power level required for cylinder ignition, the power level adjusted based on the degree of valve heating required. This includes reducing the power level and operating the laser ignition device at the lower power level to planar sweep across the intake valve, thereby expediting intake valve heating. Planar sweeping the intake valve includes, at 415, sweeping across the bottom of the intake valve when the valve is closed. In one example, the valve is closed at the beginning and end of the intake stroke in each cylinder. As another example, the valve is closed when the valve heating is enabled before an engine start has commenced. Planar sweeping the intake valve further includes, at 416, sweeping across the top of the intake valve, in particular a portion of the top of the intake valve that is within line of sight of the laser, when the intake valve is open, such as during the intake stroke. Planar sweeping the intake valve further includes, at 418, adjusting laser pulse parameters for operating the laser ignition device at least during the intake stroke based on the modeled intake valve temperature relative to the desired valve temperature. At the same time, the output may be adjusted to heat the valve to a sufficient level without damaging the intake valve. As an example, a pulse output including the pulse energy level may be increased as a difference between the modeled intake valve temperature and the desired valve temperature increases. As another example, the timing of the pulses may be adjusted to increase the frequency of the pulses as the difference between the modeled intake valve temperature and the desired valve temperature increases.

In one example, the controller may use a model or control algorithm that determines a degree of heating desired based on the difference between the modeled intake valve temperature and the desired valve temperature, and selects a laser output to apply for valve heating based on the difference. Alternatively, the controller may use a look-up table that uses the difference as an input to generate a laser ignition power output. The controller may then select a combination of laser power level, laser pulse frequency, and laser focal point that provides that laser ignition output. In one example, as the difference increases, the laser may be operated at a lower power level with a higher frequency. In another example, when the valve is cool, the valve may need full laser power rapid heating wherein the laser is operated at the level for cylinder ignition with a higher frequency. If too much local heating results, then the controller may move the laser beam more rapidly during the sweep or unfocus the beam to a larger area. Alternatively, the controller may reshape the laser output so that the contact surface changes from a pin-point beam to a line or to a plane.

At 420, the method includes operating the laser ignition device at the higher power level during the power stroke of each cylinder to initiate cylinder combustion. A pulse output including the pulse energy level during the power stroke may be adjusted as a function of engine speed and combustion air/fuel ratio. As an example, the output may be increased as at higher engine speeds. As another example, the timing of the pulses may be adjusted to increase the frequency of the pulses as the engine speed increases. In this way, the laser ignition device may be operated to heat the intake valve while also initiating cylinder combustion.

Adjusting the pulse parameters as a function of the modeled IVT may include the controller determining a control signal to send to the laser exciter, such as a pulse width, pulse amplitude, and pulse frequency/timing of the signal based on a determination of the difference between the modeled IVT and the target IVT. The controller may determine the pulse width and timing through a determination that directly takes into account the modeled IVT, such as increasing the pulse width or increasing the pulse frequency with an increasing difference between the modeled IVT and the target IVT. The controller may alternatively determine the pulse width based on a calculation using a look-up table with the input being modeled IVT and the output being pulse-width.

It will be appreciated that during very cold conditions, such as when the engine is started while the ambient temperature or engine temperature is very cold (e.g., lower than a threshold), the laser device may not have enough energy or time to heat the valve rapidly. During cold conditions, before the engine warms-up, very little fuel may vaporize. At this time, getting any portion of the fuel to vaporize can provide significant benefits. Therefore during such conditions, the laser may be operated to heat a smaller predefined area of the intake valve to create a warm spot (or hot spot) that will evaporate enough fuel to improve engine start and warm-up. In this way, the trajectory of the laser pulse may be varied as a function of the modeled IVT.

At 422, it may be determined if the modeled IVT is at or above the desired IVT. That is, it may be determined if the intake valve has been sufficiently warmed. If not, then at 426, the method includes maintaining the lower power laser ignition device operation for intake valve temperature control while also continuing to use the laser ignition device for initiating cylinder combustion. If the target IVT has been reached or exceeded, then at 424, the method includes discontinuing the lower power laser ignition device operation for intake valve temperature control while continuing to use the laser ignition device for initiating cylinder combustion. The routine then ends.

It will be appreciated that even after the target IVT is reached, the controller may continue intermittently modeling the IVT and adjusting laser operation during the intake stroke based on the modeled IVT so that the intake valve can be maintained sufficiently warm, even as engine operating conditions change. For example, if there is a change (e.g., drop) in valve temperature while the engine is combusting, the intake valve heating may be resumed. This may occur, for example, due to an engine deceleration fuel shut-off (DFSO) event, a transient shift to hybrid vehicle operation in an electric mod, or extended engine operation at light loads. During such conditions, due to the intake valve not being fully warmed, the intake valve heating may be resumed, such as by operating the laser ignition device in a mode where it delivers a laser pulse at a lower level/output during the intake stroke for intake valve heating, and at a higher level/output during the power stroke for cylinder ignition. As an example, the laser may be operated in a first mode responsive to an engine start request, before a first combustion event of the engine start, to heat the intake valve. The laser may then be transitioned to a second mode after the first combustion event of the engine start to ignite an air-fuel mixture in the cylinder. Further, responsive to an inferred intake valve temperature during cylinder combustion (dropping below a target temperature), the laser may be operated in a third mode to ignite the air-fuel mixture in the cylinder and heat the intake valve. Therein, when operating in the first mode, the laser operates at a lower power level with the laser focused as a pin-point beam on a bottom surface of the intake valve, while when operating in the second mode the laser is operated at a higher power level with the laser focused on a cylinder piston surface during a power stroke of the cylinder. When operating in the third mode, the laser is operated at the lower power level during an intake stroke with the laser focused on the bottom surface of the intake valve when the valve is closed and on a top surface of the intake valve when the valve is open, and operating the laser at the higher power level during the power stroke with the laser focused on the piston surface. The third mode may then be maintained until the inferred intake valve temperature is higher than a threshold, and then the laser may be transitioned from the third mode to the second mode. As discussed earlier, the inferred intake valve temperature is modeled as a function of engine speed, engine load, engine temperature, and heat of combustion, and the threshold is based on each of ambient air temperature, exhaust particulate matter load, and a split ratio of fuel delivered to the cylinder via port injection relative to direct injection.

In one example, responsive to a drop in driver demand, the engine controller may discontinue cylinder fuel injection and decelerate the engine; and then operate the laser in the first mode responsive to cylinder fuel injection being discontinued for longer than a threshold duration. As another example, where the engine is coupled in a hybrid vehicle including an electric motor, the controller may operate the laser in the first mode responsive to vehicle propulsion via the electric motor for longer than a threshold duration.

During all modes where valve heating is performed, responsive to the valve getting heated too fast, the controller may unfocus the beam so that the beam changes from a pin-point on the valve surface to a line or lane. Additionally or optionally, the controller may sweep the beam over the intake valve faster.

In this way, intake valve heating may be used to improve engine startability, cold-start tailpipe emissions, and fuel vaporization.

Figure 5:
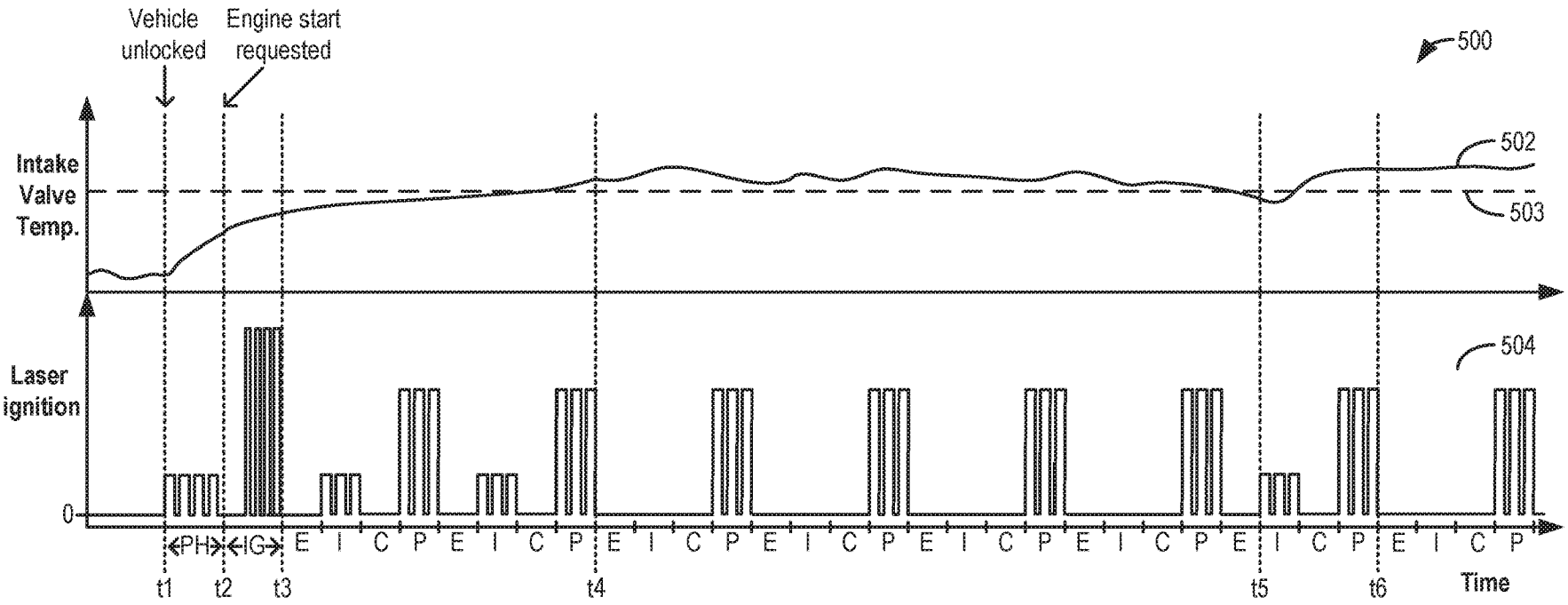
FIG. 5 shows an example intake valve heating operation using the laser ignition device for improving engine start quality.

Turning now to FIG. 5, an example operation of a laser ignition system (such as the laser system of FIG. 1) for cylinder combustion and intake valve heating, in relation to the combustion cycle during an engine start, is shown at map 500. Engine operation in FIG. 5 includes an intake valve pre-heating (PH) operation before an engine start is requested, a first combustion or ignition (IG) during a cranking operation, followed by engine speed run-up. A cranking operation may involve the engine reaching a threshold speed via use of a starter motor, such as up to 50 rpm, followed by a first combustion event IG wherein fuel is injected and combusted for the first time on that drive cycle. Following the first combustion IG, engine 10 may have one or more combustions before settling down to idle. The following is a detailed discussion of laser operation in the different phases of engine operation over a given drive cycle. Map 500 depicts a modeled intake valve temperature at plot 502, relative to a threshold intake valve temperature 503 (dashed line). Laser ignition device operation, including a frequency, amplitude, and width of each laser pulse is shown at plot 504.

Prior to t1, the vehicle is shut down and the laser ignition device is disabled. Due to cooler ambient temperatures, the modeled IVT is below threshold temperature 503. At t1, a vehicle unlocking request is received from a vehicle operator (such as responsive to the vehicle operator unlocking the vehicle to initiate vehicle pre-conditioning, for example, to cool or heat the cabin to a target cabin temperature).

Responsive to the vehicle unlocking request, the laser ignition device is operated in a first, pre-heating mode (PH). Between t1 and t2, the laser exciter of the laser system is instructed by the LCU to generate a first plurality of lower power laser pulses, the laser pulses focused at a first location on a bottom surface of the closed intake valve to expedite valve heating, the quantity or frequency of the pulses shown in FIG. 5 are only illustrative. The actual pulses may be at frequencies exceeding 1000 Hz. Due to the laser operation, the modeled IVT starts to rise.

At t2, an engine start request is received. Responsive to the engine start request, the engine is cranked via a started motor and the laser ignition device is enabled. After the engine has been cranked for a duration, engine fueling is resumed and the laser ignition device is operated in a second, non-heating mode during a first combustion event (IG) of the drive cycle. When operating in the second non-heating mode, between t2 and t3, the laser exciter is instructed by the LCU to generate a second plurality of higher power laser pulses, the laser pulses focused at a second location on the piston surface to commence combustion. For example, the laser pulses may be focused near top dead center of a power stroke (P), while the laser exciter remains dormant during the intake (I), compression (C) and exhaust (E) strokes.

After t3, the laser ignition device is returned to the first operating mode for heating the intake valve during the intake stroke (due to the modeled IVT still being below threshold 503), and then transitioning to a third operating mode for initiating cylinder combustion during the power stroke of each combustion cycle. In the third operating mode, the laser exciter is instructed by the LCU to generate a third plurality of higher power laser pulses, the laser pulses focused at a third location on the piston surface to commence combustion. The third plurality of laser pulses may be generated during power stroke P at an energy level that is lower than the energy level for the first combustion IG, but higher than the energy level for intake valve heating. The third location may also be different from the second location where the pulses are focused on when initiating combustion on the first combustion event. For example, on the first combustion event, the laser exciter may focus the laser light energy near top dead center of a power stroke (P). In comparison, when initiating combustion after the first combustion event, the laser exciter may focus the laser light energy on cylinder walls.

The combustion cycle continues in the order of intake stroke I, compression stroke C, power stroke P, and exhaust stroke E before beginning again with intake stroke I, all the while with the laser exciter generating the first plurality of lower power laser pulses during the intake stroke I for intake valve heating and the third plurality of higher power laser pulses during the power stroke P for combustion.

The energy level of the third plurality of laser pulses may vary from power stroke P to power stroke P depending on the engine speed and air/fuel ratio. For example, a leaner air/fuel mixture may operate with a relatively higher laser energy level than a less lean, or more rich air/fuel mixture in order to combust the lean air/fuel mixture more efficiently, and lower engine speeds may be associated with a poor mixture of air and fuel, and therefore may also benefit from a higher laser energy level than higher engine speeds in order to improve combustion.

Before t4, the modeled IVT may exceed threshold 503 and therefore laser operation in the intake stroke for intake valve heating is discontinued while continuing laser operation in the power stroke for combustion initiation. Between t4 and t5, the engine is operated with laser ignition in the power stroke only.

Shortly before t5, due to a change in engine operating conditions, the engine enters a deceleration fuel shut-off (DFSO) mode wherein engine fueling is temporarily disabled for fuel economy purposes. As a result of the DFSO, the valve temperature starts to drop. At t5, responsive to the drop in valve temperature, laser operation for intake valve heating is resumed. Also shortly after t5, engine fueling is resumed. Laser operation for intake valve heating is continued until t6 wherein due to the laser valve heating as well as heat from cylinder combustion, the valve temperature rises sufficiently. At t6, laser operation in the intake stroke for intake valve heating is discontinued and thereafter the engine is operated with laser ignition in the power stroke only.

In this way, a laser ignition system may advantageously use a laser for both igniting an air/fuel mixture and heating the intake valves of a cylinder. By reducing the fuel losses associated with cold intake valves, such as during a cold start, the combustion efficiency and likewise the fuel economy increases. The technical effect of heating an intake valve to improve fuel vaporization during a cold start is that engine startability issues associated with port injected fuel delivery are reduced. By initiating heating of engine intake valves in anticipation of an engine start, engine warm-up time is reduced. In addition, engine cold-start tailpipe emissions and engine hesitations are reduced, improving engine performance. While broadly applicable to a vehicle having an engine that is started at the beginning of a vehicle cold start procedure, the disclosed method is additionally beneficial towards vehicles associated with engines that do not turn over at the beginning of the cold start procedures, such as in the case of hybrid vehicles.

One example method for an engine comprises: operating a laser ignition device with an output that is lower than a level for initiating cylinder ignition, the output adjusted based on intake valve temperature. In the preceding example, additionally or optionally, each of a power level, a pulse frequency, a focal point, and a pulse width of the output is adjusted based on the intake valve temperature. In any or all of the preceding examples, additionally or optionally, the engine is coupled in a vehicle and wherein operating the laser ignition device includes operating the laser ignition device responsive to a signal for vehicle unlocking, the operating of the laser ignition device initiated before a first combustion event in the engine. In any or all of the preceding examples, additionally or optionally, the method further comprises, during and after the first combustion event, operating the laser ignition device with the output at the lower level during an intake stroke of a combustion cycle, and operating the laser ignition device with the output at the level for initiating cylinder ignition during a power stroke of the combustion cycle. In any or all of the preceding examples, additionally or optionally, the intake valve temperature is modeled based on engine operating conditions including engine speed, engine load, and ambient temperature. In any or all of the preceding examples, additionally or optionally, the output of the laser ignition device is adjusted to raise the modeled intake valve temperature above a target valve temperature, the target valve temperature based on each of engine temperature, exhaust particulate matter load, and a split ratio of fuel delivered via port injection relative to direct injection. In any or all of the preceding examples, additionally or optionally, the target valve temperature is raised as the split ratio of fuel delivered via port injection relative to direct injection increases, and wherein the intake valve is coupled downstream of a port injector in an intake port. In any or all of the preceding examples, additionally or optionally, the modeled intake valve temperature is further based on laser heat generated during laser ignition device operation, combustion heat generated during cylinder combustion, and a rate of transfer of intake air heat. In any or all of the preceding examples, additionally or optionally, laser energy from the laser ignition device is directed onto a bottom surface of an intake valve when the intake valve is closed, and wherein the laser energy is directed onto a top surface of the intake valve when the intake valve is open.

Another example method for an engine comprises: in response to an inferred intake valve temperature being lower than a threshold, operating a laser ignition device to sweep an intake valve of a cylinder during an intake stroke until the intake valve temperature is higher than the threshold. In any or all of the preceding examples, additionally or optionally, sweeping the intake valve during the intake stroke includes sweeping a bottom surface of the intake valve when the intake valve is closed, and sweeping a top surface of the intake valve when the intake valve is open. In any or all of the preceding examples, additionally or optionally, the method further comprises: operating the laser ignition device to ignite an air-fuel mixture during a power stroke of the cylinder, wherein a laser output when operating during the intake stroke is lower than the laser output when operating during the power stroke. In any or all of the preceding examples, additionally or optionally, operating the laser ignition device during the intake stroke includes operating with a lower energy level, a lower frequency of laser pulse emission, and with a laser pulse directed onto the intake valve of the cylinder, and wherein operating the laser ignition device during the power stroke includes operating with a higher energy level, a higher frequency of laser pulse emission, and with the laser pulse directed onto a piston of the cylinder. In any or all of the preceding examples, additionally or optionally, the inferred intake valve temperature is modeled based on each of engine speed, engine load, engine temperature, and heat generated during the operating of the laser ignition device. In any or all of the preceding examples, additionally or optionally, the threshold is based on each of ambient air temperature, exhaust particulate matter load, and a split ratio of fuel delivered to the cylinder via port injection relative to direct injection, the threshold raised as the split ratio increases, as the particulate matter load increases, and as the ambient air temperature decreases.

Another example vehicle system comprises: an engine including a cylinder having an intake valve; a port injector coupled to the cylinder upstream of the intake valve; a direct injector coupled to the cylinder; a laser coupled to the cylinder; and a controller. The controller may be configured to have computer-readable instructions stored on non-transitory memory for: responsive to an engine start request, operating the laser in a first mode before a first combustion event of the engine start to heat the intake valve; transitioning the laser to a second mode after the first combustion event of the engine start to ignite an air-fuel mixture in the cylinder; and responsive to a drop in inferred intake valve temperature during cylinder combustion, operating the laser in a third mode to ignite the air-fuel mixture in the cylinder and heat the intake valve. In any or all of the preceding examples, additionally or optionally, operating in the first mode includes operating at a lower power level with the laser focused on a bottom surface of the intake valve, wherein operating in the second mode includes operating at a higher power level with the laser focused on a cylinder piston surface during a power stroke of the cylinder, and wherein operating in the third mode includes operating the laser at the lower power level during an intake stroke with the laser focused on the bottom surface of the intake valve when the valve is closed and on a top surface of the intake valve when the valve is open, and operating the laser at the higher power level during the power stroke with the laser focused on the piston surface. In any or all of the preceding examples, additionally or optionally, the controller includes further instructions for maintaining operation in the third mode until the inferred intake valve temperature is higher than a threshold, and then transitioning from the third mode to the second mode, wherein the inferred intake valve temperature is modeled as a function of engine speed, engine load, engine temperature, and heat of combustion, and wherein the threshold is based on each of ambient air temperature, exhaust particulate matter load, and a split ratio of fuel delivered to the cylinder via port injection relative to direct injection. In any or all of the preceding examples, additionally or optionally, the controller includes further instructions for: responsive to a drop in driver demand, discontinuing cylinder fuel injection and decelerating the engine, and operating the laser in the first mode responsive to cylinder fuel injection being discontinued for longer than a threshold duration. In any or all of the preceding examples, additionally or optionally, the vehicle is a hybrid vehicle further including an electric motor, and wherein the controller includes further instructions for operating the laser in the first mode responsive to vehicle propulsion via the electric motor for longer than a threshold duration.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

in response to an inferred intake valve temperature being lower than a threshold, operating a laser ignition device to sweep an intake valve of a cylinder during an intake stroke until the inferred intake valve temperature is higher than the threshold.

2. The method of claim 1, wherein sweeping the intake valve during the intake stroke includes sweeping a bottom surface of the intake valve when the intake valve is closed and sweeping a top surface of the intake valve when the intake valve is open.

3. The method of claim 1, further comprising operating the laser ignition device to ignite an air-fuel mixture during a power stroke of the cylinder, wherein a laser output when operating during the intake stroke is lower than a laser output when operating during the power stroke.

4. The method of claim 3, wherein operating the laser ignition device during the intake stroke includes operating with a lower energy level, a lower frequency of laser pulse emission, and with a laser pulse directed onto the intake valve of the cylinder, and wherein operating the laser ignition device during the power stroke includes operating with a higher energy level, a higher frequency of laser pulse emission, and with the laser pulse directed onto a piston of the cylinder.

5. The method of claim 3, wherein the inferred intake valve temperature is modeled based on each of engine speed, engine load, engine temperature, and heat generated during the operating of the laser ignition device.

6. The method of claim 5, wherein the threshold is based on each of ambient air temperature, exhaust particulate matter load, and a split ratio of fuel delivered to the cylinder via port injection relative to direct injection, the threshold raised as the split ratio increases, as the particulate matter load increases, and as the ambient air temperature decreases.

* * * * *